US005616058A

United States Patent [19]

Nakai

[11] Patent Number: 5,616,058

[45] Date of Patent: Apr. 1, 1997

[54] LIFT ARRANGEMENT FOR OUTBOARD MOTOR ENGINE

[75] Inventor: Hiroshi Nakai, Hamamatsu, Japan

[73] Assignee: Sanshin Kogyo Kabushiki Kaisha, Shizuoka, Japan

[21] Appl. No.: 507,116

[22] Filed: Jul. 26, 1995

[30] Foreign Application Priority Data

Jul. 30, 1994 [JP] Japan ..... 6-197281

[51] Int. Cl.[6] ..... B63H 5/12

[52] U.S. Cl. ..... 440/53; 123/195 P

[58] Field of Search ..... 440/53, 88, 89, 440/900, 113; 294/82.12; 123/195 P, 195 A

[56] References Cited

U.S. PATENT DOCUMENTS

| | | | |
|---|---|---|---|
| 4,765,075 | 8/1988 | Nakase et al. | 114/270 |
| 5,049,100 | 9/1991 | Yamamoto et al. | 440/88 |

OTHER PUBLICATIONS

Page 8 of the Johnson Super Sea Horse 55HP Owner's Manual 1969.

Page 2B–3 of the Mercruiser Service Manual No. 1, GM V–8 Cylinder 1990.

Page 4–10 of the Johnson Outboards Sevice Manual 150, 150C, 175 1992.

*Primary Examiner*—Edwin L. Swinehart

*Attorney, Agent, or Firm*—Knobbe, Martens, Olson & Bear, LLP

[57] ABSTRACT

A lift arrangement for a marine engine permits the output shaft of the engine to be vertically oriented when lifting the engine. The engine configuration results in a center of gravity located along a vertical axis which passes through a flywheel assembly of the engine. The flywheel assembly sits above an upper end of the engine block. The lift arrangement includes a pair of hangers mounted to the top end of the engine with the flywheel assembly positioned generally therebetween. The hangers are attached on opposite sides of a central, longitudinal plane of the engine. The hangers also are arranged such that a line between the hangers intersects the central, longitudinal plane at a point proximate to the vertical axis which passes through the center of gravity of said engine. With a cable connected to each hanger, the engine can hang by the cable from a lift with its output shaft vertically oriented, without removing or interfering with the flywheel assembly.

20 Claims, 3 Drawing Sheets

LIFT ARRANGEMENT FOR OUTBOARD MOTOR ENGINE

BACKGROUND OF THE INVENTION

1. Field of the Invention

The present invention relates in general to a marine engine. In particular, the present invention relates to a lift arrangement for an engine of an outboard drive.

2. Description of Related Art

Outboard motors today commonly employ a vertically oriented internal combustion engine. The engine conventionally is mounted with its output shaft (i.e., crankshaft) extending along a generally vertical axis.

The installation of the engine in this orientation is made difficult because prior engines conventionally are not suspended from motor lifts with their crankshafts vertically oriented during assembly. Rather, engine designs have dictated that the engine be picked up at a point off center from the center of gravity of the engine.

For instance, in a four-cycle engine, the position of the flywheel assembly requires that the engine be suspended from a point off a vertical axis which passes through the center of gravity of the engine. In a four-cycle engine, with a cylinder block interposed between a crankcase and a cylinder head, the center of gravity lies to the side of the crankshaft axis, toward the cylinder head and beneath the flywheel assembly. Because flywheel assemblies typically cover most of the upper end of the crankcase and the cylinder block, engines have been suspended from a point on the cylinder head. Specifically, outboard engines commonly include an eyelet attached to the cylinder head for this purpose.

Prior outboard engines, when hung from the conventional eyelet, however, hang in a skewed position. The engine thus must be swung to vertically orient the crankshaft before the crankshaft is connected with the drive shaft and the engine is lowered onto the lower tray of the outboard motor housing. Vertical orientation of the crankshaft represents an additional assembly step and complicates the assembly process.

SUMMARY OF THE INVENTION

A need therefore exists for an engine lift arrangement which permits a marine engine to hang from a lift in a position with its output shaft vertically oriented without interfering with or requiring removal of an upper flywheel assembly of the engine.

Thus, in accordance with an aspect of the present invention, an engine for a marine outboard drive comprises an engine block which supports a vertically oriented output shaft. A flywheel assembly is coupled to the output shaft and is positioned so as to cover a portion of an upper end of the engine block. First and second hangers are positioned on opposite sides of the engine upper end with the flywheel assembly positioned generally between the hangers. The engine is arranged such that a center of gravity of the engine lies along a vertical axis which passes through the flywheel assembly. The first and second hangers are arranged on the engine such that a line extending directly between the first and second hangers can be drawn to intersect the vertical axis on which the center of gravity of the engine lies.

Another aspect of the present invention involves an engine for a marine outboard drive. The engine comprises a engine block with a first hanger coupled to the engine block toward a first end of the engine block. A second hanger is coupled to the engine block toward an opposite, second end of the engine block. The first and second hangers are arranged on the engine such that a line extending between the hangers intersects a central, longitudinal plane of the engine at a point proximate to a vertical axis which passes through a center of gravity of the engine.

BRIEF DESCRIPTION OF THE DRAWINGS

These and other features of the invention will now be described with reference to the drawings of a preferred embodiment which is intended to illustrate and not to limit the invention, and in which.

DETAILED DESCRIPTION OF A PREFERRED EMBODIMENT

Figure 1:
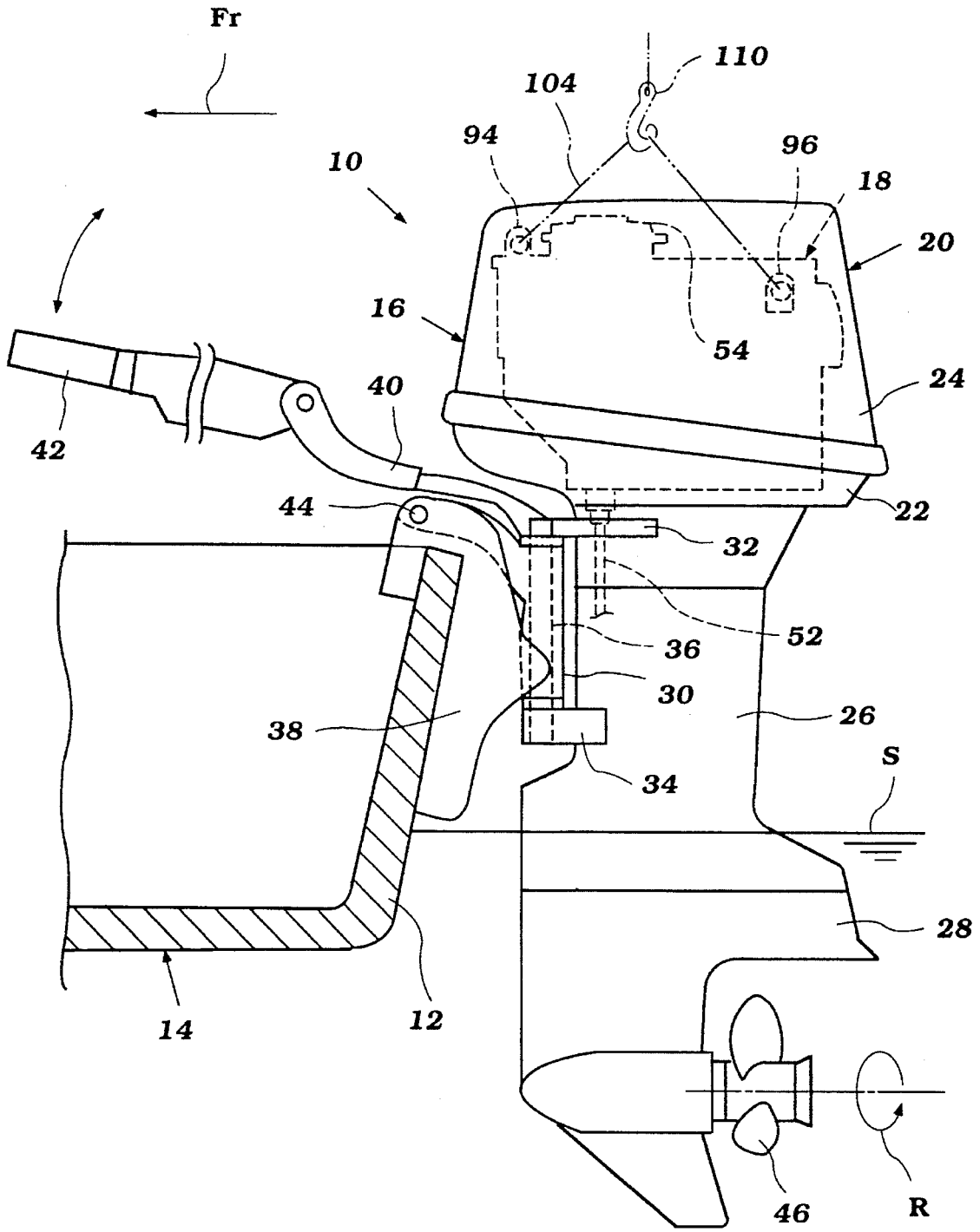
FIG. 1 is a side elevational view of an outboard motor schematically illustrating a lift arrangement configured in accordance with a preferred embodiment of the present invention.

FIG. 1 illustrates a marine outboard drive 10 which incorporates an engine lift arrangement configured in accordance with a preferred embodiment of the present invention. In the illustrated embodiment, the outboard drive 10 is depicted as an outboard motor for mounting on a transom 12 of a watercraft 14. It is contemplated, however, that certain aspects of the present invention can be employed with an inboard/outboard motor as well.

In the embodiment illustrated in FIG. 1, the outboard drive 10 has a power head 16 which includes an internal combustion engine 18. The engine 18 in the illustrated embodiment is a four-stroke, in-line, four-cylinder combustion engine. It will be readily apparent to those skilled in the art, however, that the invention may be employed with engines having other numbers of cylinders, having other cylinder orientations, and/or operating on other than a four-stroke principle.

A protective cowling assembly 20 surrounds the engine 18. The cowling assembly 20 desirably includes a lower tray portion 22 and a top cowling member 24. These elements 22, 24 of the protective cowling assembly 20 together define an engine compartment which houses the engine 18.

A drive shaft housing 26 extends from the lower tray 20 and terminates in a lower unit 28. As illustrated in FIG. 1, the lower unit 28 conventionally lies below the surface S of the body of water in which the outboard drive 10 is operated.

A swivel housing 30, attached to the drive shaft housing 26 by upper and lower brackets 32, 34, affixes and journals a steering shaft 36 about a vertical steering axis for steering purposes. A clamping bracket 38 in turn supports the swivel housing 30. A steering arm 40 is connected to the upper end of the steering shaft 36 for steering the outboard motor, as known in the art. A steering and throttle control assembly 42 is pivotably attached to an outer end of the steering arm 40 to operate the steering arm 40 for manually steering the watercraft.

A tilt pin 44 couples the swivel housing 30 to the clamping bracket 38 such that the swivel housing 30 can rotate relative to the clamping bracket 38 about the axis of the tilt pin 44. The clamping bracket 38, in turn, is configured to be attached to the transom 12 of the watercraft 14.

This conventional coupling permits the outboard drive 10 to be pivoted relative to the steering bracket 30 for steering purposes, as well as to be pivoted relative to the pin 36 to permit adjustment to the trim position of the outboard drive 10 and for tilt up of the outboard drive 10 for dry storage purposes.

Although not illustrated, it is understood that a conventional hydraulic tilt and trim cylinder assembly, as well as a conventional hydraulic steering cylinder assembly could be used as well with the present outboard drive 10. It is also understood that the above description of the construction of the outboard drive is conventional, and, thus, further details of the steering, trim, and mounting assemblies are not necessary for an understanding of the present invention.

The lower unit 28 houses a drive transfer mechanism (not shown) which selectively establishes a driving condition of a propulsion device 46, such as, for example, a propeller, a counter rotating propeller system, or a hydrodynamic jet propulsion system. That is, the drive transfer mechanism selectively couples the engine 18 to the propulsion device 46. The drive transfer mechanism desirably comprises a forward/neutral/reverse-type transmission to drive the watercraft in any of these three operating states. In the illustrated embodiment, the propulsion device 46 rotates in the counterclockwise direction R to propel the watercraft in the forward direction Fr.

Figure 2:
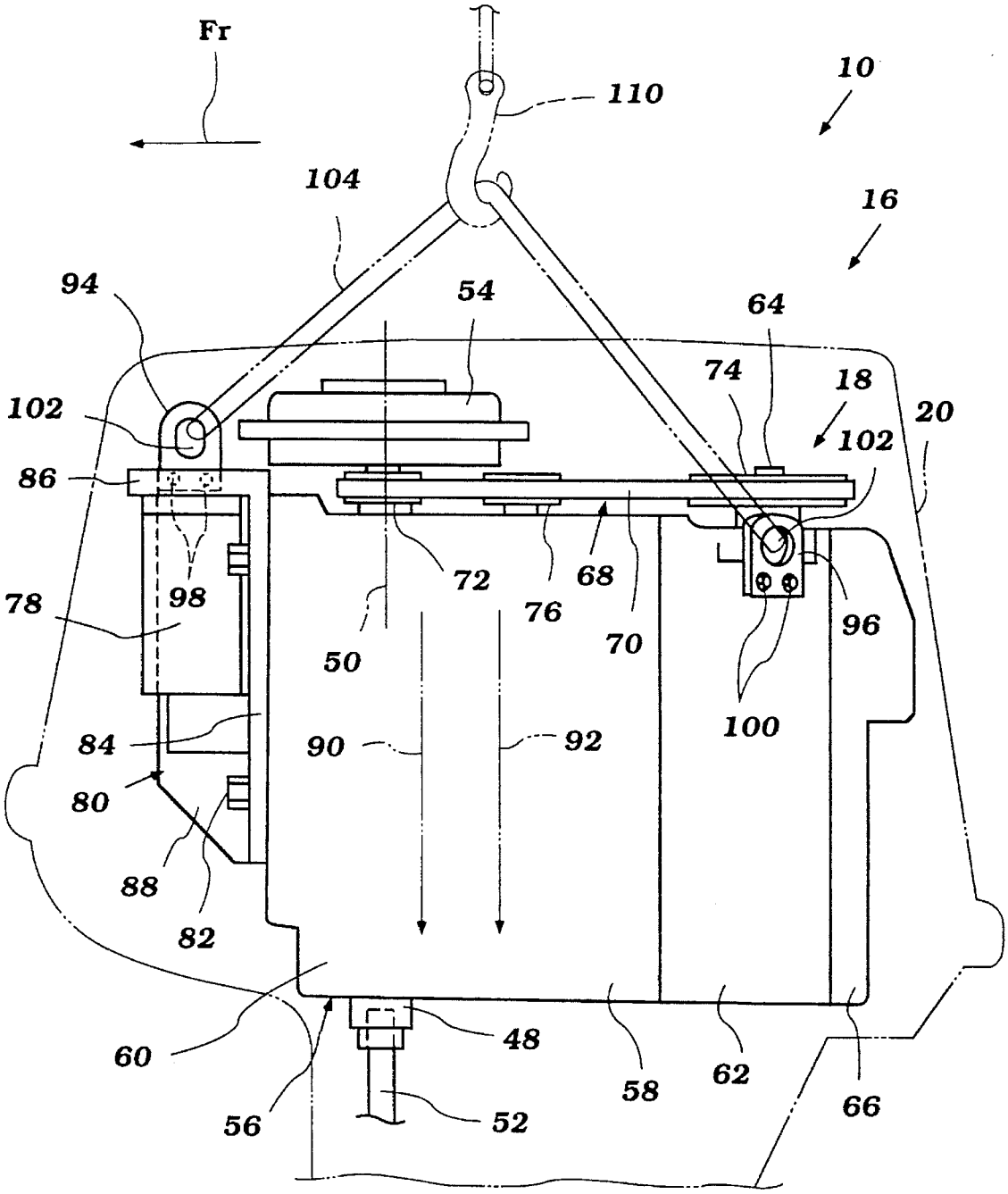
FIG. 2 is an enlarged side elevational view of a power head of the outboard drive of FIG. 1.

As best understood from FIG. 2, the engine 18 is conventionally mounted with its output shaft 48 (i.e., crankshaft) extending about a generally vertical axis 50. The crankshaft 48 drives a drive shaft 52, which depends downward from the power head 16 of the outboard drive 10. A conventional spline connection interconnects the crankshaft 48 and the drive shaft 52. This slip connection allows the crankshaft 48 to be easily dropped onto or lifted off the drive shaft 52, provided the shafts 48, 52 are vertically aligned.

As schematically illustrated in FIG. 1, the drive shaft 52 extends through and is journaled within the drive shaft housing 26. The lower end of the drive shaft 52 drives the drive transfer mechanism (not shown) housed within the lower unit 28.

A standard magneto generator/flywheel assembly 54 is attached to the upper end of the crank shaft 48. The magneto generator/flywheel assembly 54 generally has a disk-like shape and covers a portion of the upper side of an engine block 56.

The engine 18 includes a cylinder block 58 which in the illustrated embodiment includes a plurality of in line cylinder bores (not shown). Pistons (not shown) reciprocate within the cylinder bores, and connecting rods (not shown) link together the pistons and the crankshaft 48 so that the reciprocal linear movement of the pistons within the cylinder bore rotates the crankshaft 48 in a known manner. A crankcase 60 is attached to the cylinder block 58 and surrounds at least a portion of the crankshaft 48. The crankshaft 48 is journaled within the a crankcase chamber, which is formed by the crankcase 60 and the cylinder block 58, so as to rotate about the vertical axis 50.

A cylinder head 62 is attached to the opposite end of the cylinder block 58 to close an end of the cylinder bores. The cylinder head 62 has a conventional construction and supports a plurality of intake and exhaust valves (not shown). The cylinder head 62 also journals and houses at least one camshaft 64 which operates the valves.

A cam cover 66 and the cylinder head 62 together define a cam chamber in which the valves, camshaft 62, and conventional valve actuating mechanism are located. The cam cover 66 is attached to the cylinder head 58 on a side opposite that of the cylinder block 58.

Figure 3:
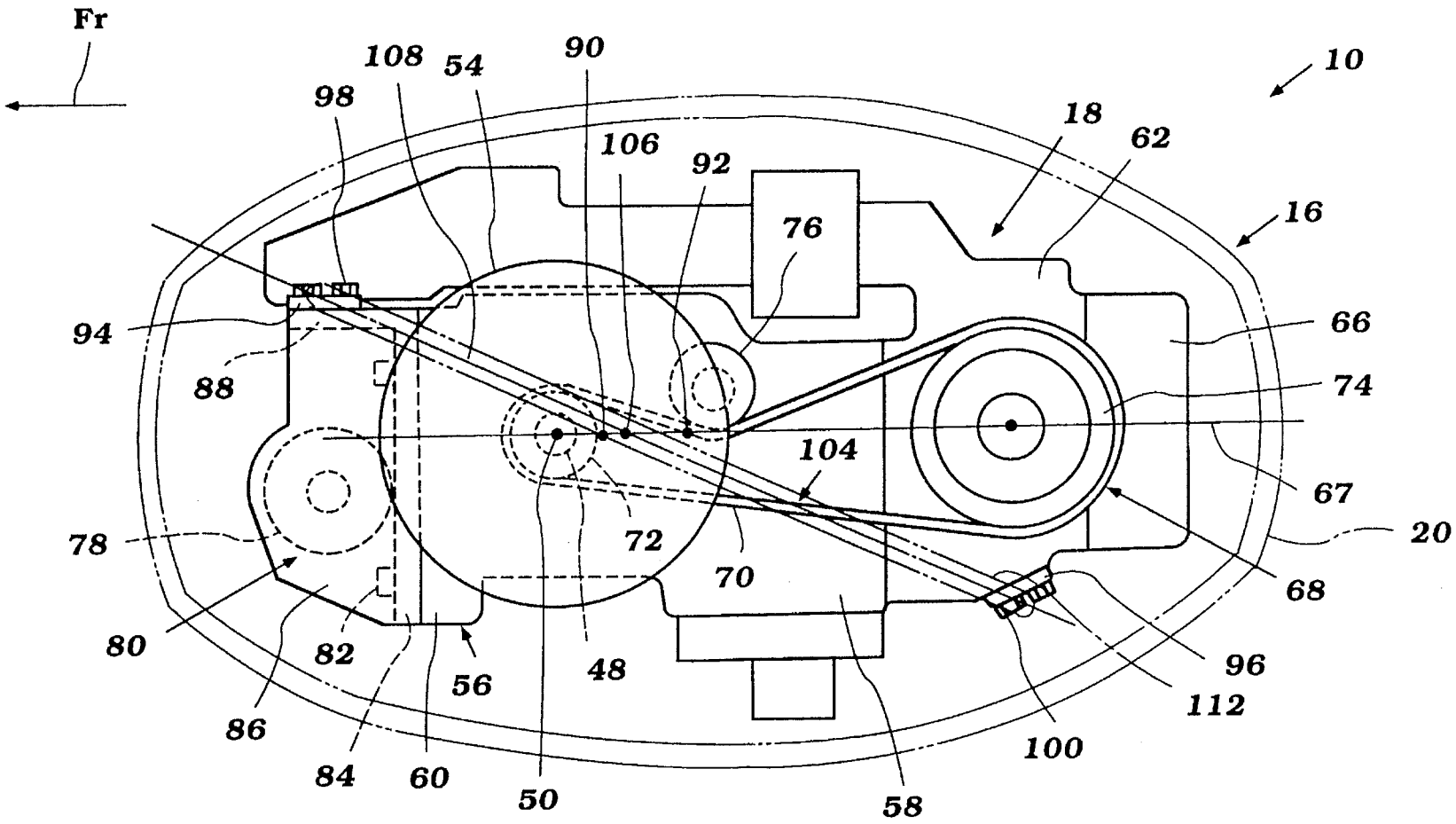
FIG. 3 is a top plan view of the power head of FIG. 2.

As understood from FIG. 3, the axes of the crankshaft 64 and the camshaft 48 generally lie within a common, generally vertical, central plane 67. The central plane 67 extends through the engine block 56 in a longitudinal direction so as to generally bifurcate each cylinder of the engine 18. The central plane 67 also lies at the center of the outboard drive 10.

With reference to FIGS. 2 and 3, the crankshaft 48 drives the camshaft 64 through a timing mechanism 68 which includes a timing belt 70. The timing belt 70 extends between the a pulley 72 positioned on an upper end of the crankshaft 48 beneath the flywheel assembly 54, and a pulley 74 coupled to the camshaft 64. In the exemplary four-stroke engine 18, the camshaft pulley 74 has a diameter twice that of a pulley on the crankshaft 72 so that the crankshaft 48 drives the camshaft 64 at half the rotational speed of the crankshaft 48, as known in the art.

As best seen in FIG. 3, a conventional belt tensioner 76 holds the timing belt 70 on its pulleys 72, 74. In the illustrated embodiment, the belt tensioner 76 is a spring-loaded wheel that pushes one side of the belt toward an opposite side to maintain a desired amount of tension in the timing belt 70.

In the illustrated embodiment, as seen in FIGS. 2 and 3, a starter motor 78 is used to electrically start the engine 18. Although not illustrated, the starter motor 78 includes a conventional pinion gear which engages the flywheel gear ring of the magneto generator/flywheel assembly 54.

A bracket 80 supports the starter motor 78 on the front end of the engine 18. That is, the bracket 80 is attached to the front, vertically-oriented surface of the crankcase 60. Bolts 82 secure the bracket 78 to the crankcase 60.

The bracket 80 extends to the front side of the engine 18 away from the crankcase 60 and the magneto generator/flywheel assembly 54. In the illustrated embodiment, the bracket 80 includes a base 84 mounted against the end of the crankcase 60, a top flange 86 and a side flange 88. The starter motor 78 is positioned between the top and side flanges 86, 88 of the bracket 80.

As understood from FIG. 3, the center of gravity of the present engine 18 and the center of gravity of the present outboard drive 10 both desirably lie within the central, longitudinal plane 67. With the engine 18 constructed accordingly, the center of gravity of the engine 18 lies along a generally vertical axis 90 located between the axes of the crankshaft 48 and the camshaft 64. In the illustrated embodiment, the vertical axis 90 on which the center of gravity of the engine 18 lies is positioned adjacent to the axis of the crankshaft 48, beneath the magneto generator/flywheel assembly 54.

As also seen in FIGS. 2 and 3, the center of gravity of the outboard drive 10 lies along a generally vertical axis 92 which is located between the axes of the crankshaft 48 and the camshaft 64. This vertical axis 92 is located further away from the crankshaft axis 50 than the vertical axis 90 on which the engine center of gravity lies. In the illustrated embodiment, the axis 92 which passes through the center of gravity of the outboard drive 10 lies adjacent to the timing belt tensioner 76, beneath the magneto generator/flywheel assembly 54.

The engine 18 desirably includes at least a pair of hangers 94, 96 which are used to lift and suspend the engine 18, as described below. As seen in FIG. 3, the hangers 94, 96 are positioned on opposite sides of the central, longitudinal plane 67 and toward opposite ends of the engine 18. In the illustrated embodiment, a first hanger 94 of the pair is positioned on the starboard side and to the front of the engine 18. A second hanger 96 of the pair is positioned on the port side and to the rear of the engine 18. Of course, the port and starboard side locations of the hangers 94, 96 can be reversed.

The first hanger 94 is attached to the bracket 80 that supports the starter motor 78. As seen in FIG. 3, the first hanger 94 is positioned on an opposite side of the central, longitudinal plane 67 from the starter motor 78. In the illustrated embodiment, the first hanger 94 is also connected to the top end of the bracket side flange 88. In this position, as understood from FIGS. 2 and 3, the first hanger 94 lies slightly forward and to the side of the flywheel assembly 54. The first hanger 94 is also positioned at about the same vertical height as the flywheel assembly 54. Bolts 98 secure the first hanger 94 to the bracket 80 in this position.

As seen in FIG. 2, the second hanger 96 desirably is attached to the side of the cylinder head 62. In the illustrated embodiment, the second hanger 96 lies at about the same longitudinal position as the position of the camshaft 64. That is, the second hanger 96 is positioned to the side of the camshaft 64. The second hanger 96 also lies below the vertical level of the camshaft pulley 74 and below the vertical level of the first hanger 94. Bolts 100 secure the second hanger 96 at this location.

Each hanger 94, 96 includes an aperture 102 sized to receive a cable, chain, cord, or the like (generally designated by reference numeral 104) used to lift the engine 18. As seen in FIG. 2, the apertures 102 of the hangers 94, 96 desirably are larger than the lift cable or chain 104.

The hangers 94, 96 are advantageously arranged on the engine 18 such that a line extending between the hangers 94, 96 intersects the central, longitudinal plane 67 of the engine 18 at a point 106 proximate to the vertical axis 90 passing through the engine center of gravity. FIG. 3 schematically illustrates this point 106 in representing an exemplary position of the suspension cable 104 extending between the hangers 94, 96. As seen in FIG. 3, the center line 108 of the cable 104 passes through the central, longitudinal plane 67 at a point 106 proximate to the vertical axis 90. So positioned, the vertical axis 90 extends through the suspension cable 104.

The hangers 94, 96 thus are arranged such that a line can be drawn between the hangers 94, 96 to intersect the vertical axis 90 on which the engine center of gravity lies. The hangers 94, 96 also are arranged so as to be equally distanced from the central, longitudinal plane 67, and preferably are positioned symmetrically about the vertical axis 90. This arrangement of the hangers 94, 96 on the engine 18 permits a suspension cable 104 to hang from a lift hook 110 with the vertical axis 90 extending adjacent to or through the cable 104.

As noted above, the hangers 94, 96 are initially used to assemble the outboard drive 10. As understood from FIG. 2, an end of a cable 104 is attached to each hanger 94, 96. The lift hook 110 grasps the suspension cable 104 at about the cable's midpoint between the hangers 94, 96. The cable 104 desirably has an adequate length to form a sufficient angle with the horizontal so as not to interfere with or contact magneto generator/flywheel assembly 54. In the illustrated embodiment, this angle is approximately 30° with the hangers 94, 96 positioned as illustrated and described above.

The engine 18 hangs from the lift hook 110 with the axis of its crankshaft 48 in a substantially vertical position. This allows easier engagement between the conventional spline connection between the drive shaft 52 and the output shaft 48 of the engine 18 as the engine 18 is lowered onto the lower tray 22. The engine 18 is then secured to the lower tray 20 by known means. The ability to suspend the engine 18 with its output shaft 48 generally aligned along a vertical axis eases and simplifies the assembly process.

As illustrated in FIG. 3, the center of gravity of the outboard drive 10 also lies proximate to a line extending between the hangers 94, 96. For instance, line 112 which represents a rear edge of the cable 104 intersects the central, longitudinal plane 67 at a point proximate to the vertical axis 92 on which the center of gravity of the outboard drive 10 lies. FIGS. 2 and 3 illustrate the position of the lift hook 110 when the hangers 94, 96 are used to lift the entire outboard drive 10. This arrangement of the hangers 94, 96 in reference to the center of gravity of the outboard drive 10 allows the hangers 94, 96 also to be used to suspend the outboard drive 10 in a generally vertical position when loading the outboard drive 10 onto a transom 12 of a boat 14.

Although this invention has been described in terms of a certain preferred embodiment, other embodiments apparent to those of ordinary skill in the art are also within the scope of this invention. Accordingly, the scope of the invention is intended to be defined only by the claims which follow.

What is claimed is:

1. An engine for a marine outboard drive comprising an engine block supporting a vertically oriented output shaft, a flywheel assembly coupled to said output shaft and positioned so as to cover a portion of an upper end of said engine block, a camshaft disposed on an end of the engine block opposite the end at which the output shaft is disposed, a timing belt operating upper ends of the output shaft and the camshaft, and first and second hangers positioned on opposite sides of said engine upper end with said flywheel assembly positioned between said hangers and positioned at opposite ends of the engine, said engine being arranged such that a center of gravity of said engine lies along a vertical axis which passes through said flywheel assembly, said first and second hanger being arranged on said engine such that a line extending directly between said first and second hangers can be drawn across the timing belt and to intersect the vertical axis on which the center of gravity of the engine lies.

2. An engine as in claim 1, wherein said first and second hangers generally are equally distanced from said vertical axis.

3. An engine as in claim 1, wherein each hanger includes an aperture, and said line extends through the apertures of said first and second hangers.

4. An engine as in claim 1, wherein said engine includes a central, longitudinal plane defined by the axes of said crankshaft and a camshaft of said engine, said vertical axis generally lying within said central, longitudinal plane.

5. An engine as in claim 4, wherein said hangers are symmetrically positioned relative to said central, longitudinal plane.

6. An engine as in claim 4 additionally comprising a starting device positioned proximate to said first hanger but on an opposite side of said central, longitudinal plane from said first hanger.

7. An engine as in claim 6, wherein a bracket connected to said engine block supports said starting device at a front end of said engine.

8. An engine for a marine outboard drive comprising an engine block including a cylinder block interposed between a crankcase located at a first end of said engine block and a cylinder head located at an opposite, second end of said engine block, an crankshaft journalled within the crankcase to rotate about a vertically-orientated axis and a camshaft journalled within the cylinder head, a timing belt operating between the camshaft and the crankshaft, a first hanger coupled to said engine block toward the first end of said engine block and a second hanger coupled to said engine block toward the second end of said engine block, said first and second hangers being arranged on said engine such that a line extending between said hangers crosses the timing belt and intersects a central, longitudinal plane of said engine at a point near a vertical axis which passes through a center of gravity of said engine.

9. An engine as in claim 8 wherein said first and second hangers are spaced from the vertical axis on which the center of gravity of the engine lies by generally equal distances.

10. An engine as in claim 9, wherein said first hanger is attached to said cylinder head.

11. An engine as in claim 10, wherein said second hanger is attached to a bracket connected to said crankcase.

12. An engine as in claim 11 additionally comprising a starting device positioned proximate to said second hanger, but on an opposite side of said central, longitudinal plane from said second hanger.

13. An engine as in claim 12, wherein said bracket supports said starting device on a side of the crankcase opposite of the cylinder block.

14. An engine as in claim 8, wherein said vertical axis lies within the central, longitudinal plane.

15. An engine as in claim 8, wherein an axis of rotation of the crankshaft of the engine lies within the central, longitudinal plane.

16. An engine as in claim 15, wherein an axis of rotation of the camshaft of said engine lies within the central, longitudinal plane.

17. An engine as in claim 8, wherein said hangers are positioned on opposite sides of said central, longitudinal plane at symmetrical positions relative to the vertical axis on which the center of gravity of the engine lies.

18. An engine as in claim 8 additionally comprising a flywheel assembly coupled to a crankshaft of the engine and positioned on an upper end said engine, said engine being configured such that the vertical line on which the center of gravity of the engine is positioned passes through said flywheel assembly.

19. An engine as in claim 18, wherein said first and second hangers are positioned on generally opposite sides of said flywheel assembly.

20. An engine as in claim 19 arranged in the outboard drive such that a center of gravity of the outboard drive lies along a second vertical axis which generally lies within the central, vertical plane and passes through the flywheel assembly, with a line extending between said hangers intersecting the central, longitudinal plane at a point proximate to said second vertical axis.

* * * * *